US005253835A

United States Patent [19]

Herron, III

[11] Patent Number: 5,253,835

[45] Date of Patent: Oct. 19, 1993

[54] SHELF BRACKET ASSEMBLY

[76] Inventor: Warren L. Herron, III, 404 N. Sunset Blvd., Gulf Breeze, Fla. 32561-4060

[21] Appl. No.: 836,524

[22] Filed: Feb. 18, 1992

[51] Int. Cl.[5] ..... A47B 47/00

[52] U.S. Cl. ..... 248/220.2; 108/108; 108/110; 211/187; 248/243; 248/250

[58] Field of Search ..... 248/221.2, 220.2, 235, 248/243, 247, 250; 211/90, 103, 187, 193; 108/108, 110, 111, 42

[56] References Cited

U.S. PATENT DOCUMENTS

| | | | |
|---|---|---|---|
| 3,000,604 | 9/1961 | Schulze-Röbbecke | 248/243 X |
| 3,234,897 | 2/1966 | Berk | 248/243 X |
| 3,574,980 | 4/1971 | Keller | 248/243 X |
| 3,604,669 | 9/1971 | Asher | 248/243 |
| 3,614,044 | 10/1971 | Bard | 248/243 X |
| 3,645,486 | 2/1972 | Ferdinand et al. | 248/243 |
| 4,055,318 | 10/1977 | Duckett | 248/243 |
| 4,070,803 | 1/1978 | Gartung | 248/243 X |
| 4,431,155 | 2/1984 | Engel | 248/243 |
| 5,092,546 | 3/1992 | Wolfbauer | 211/193 X |

FOREIGN PATENT DOCUMENTS

| | | | |
|---|---|---|---|
| 588686 | 5/1947 | United Kingdom | 248/243 |
| 2183455 | 6/1987 | United Kingdom | 108/108 |

*Primary Examiner*—David A. Scherbel
*Assistant Examiner*—Derek J. Berger
*Attorney, Agent, or Firm*—William David Kiesel; Robert C. Tucker

[57] ABSTRACT

A shelf bracket assembly is provided, comprising a plurality of vertical shelf bracket support strips attached to a wall, each said strip having a plurality of slots aligned vertically along the length of said support strips; a plurality of shelf brackets operatively attached to said support strips, each said bracket comprising a base comprising an upper end, a lower end, and vertically aligned hooked portions between said upper and lower ends of a size and shape to lockingly fit within said vertical slots of said support strip, and a horizontal support member fixedly connected to said base and of a size and strength capable of supporting at least half the weight of a shelf; a plurality of covers attached to said support strips for covering said support strips in the space between said shelf brackets, in the space above a top said shelf bracket and in the space below a bottom said shelf bracket.

17 Claims, 4 Drawing Sheets

SHELF BRACKET ASSEMBLY

BACKGROUND OF THE INVENTION

1. Field of the Invention

This invention relates generally to adjustable shelf support systems, and more particularly to those shelf support systems which employ slotted shelf support strips having a protruding support section.

2. Prior Art

One of the most common methods of installing shelves in residential and commercial buildings involves fastening slotted shelf strips to a wall, and placing tabbed shelf support brackets into the strips. While such a basic system is adequate for many purposes, it is ill-suited for applications where the shelves are intended to support fragile items, or otherwise in cases when the side-side stability of the shelves is an important consideration. Additionally, most of the commonly used systems have little or no aesthetic appeal, due in large part to the many slots on the exposed support strip, as well as the ends of the support strips themselves, being clearly visible. A shelf support system which offers more stability to the shelves and which incorporates a means of covering the unused portions of the support strip would be desireable to marketers and consumers of such products. This is especially true if the shelf support system could be used with widely available support strips, because the components of the present invention could be used as part of an upgrade kit in replacing existing shelf brackets.

SUMMARY OF THE INVENTION

Therefore, it is an object of this invention to provide a shelf support system which has increased side-to-side stability.

It is another object of this invention to provide a shelf support system which covers portions of the support strips that are not covered by shelf brackets.

It is still another object of this invention to provide a shelf support system which is capable of being used with widely available shelf support strips.

These and other objects and advantages of the present invention will no doubt become apparent to those skilled in the art after having read the following description of the preferred embodiments and which are contained in and illustrated by the various drawing FIGURES.

Accordingly, a shelf bracket assembly is provided, comprising a plurality of vertical shelf bracket support strips attached to a wall, each said strip having a plurality of slots aligned vertically along the length of said support strips; a plurality of shelf brackets operatively attached to said support strips, each said bracket comprising a base which includes an upper end, a lower end, and vertically aligned hooked portions between said upper and lower ends of a size and shape to lockingly fit within said vertical slots of said support strip, and a horizontal support member fixedly connected to said base and of a size and strength capable of supporting at least half the weight of a shelf; a plurality of covers attached to said support strips for covering said support strips in the space between said shelf brackets, in the space above a top said shelf bracket and in the space below a bottom said shelf bracket. A modified shelf bracket is also provided which can be used to support a shelf and also to cover the lower end of said support strip.

DETAILED DESCRIPTION OF PREFERRED EMBODIMENTS OF THE INVENTION

Figure 2:
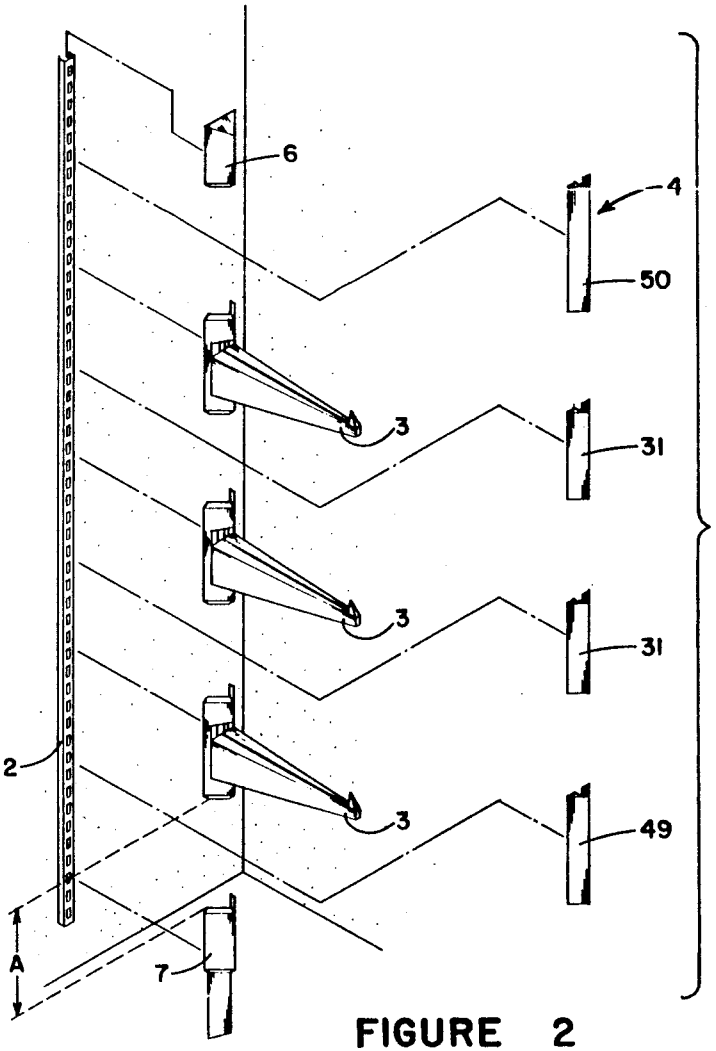
FIG. 2 is an exploded view of the invention showing the major components thereof.
Figure 1:
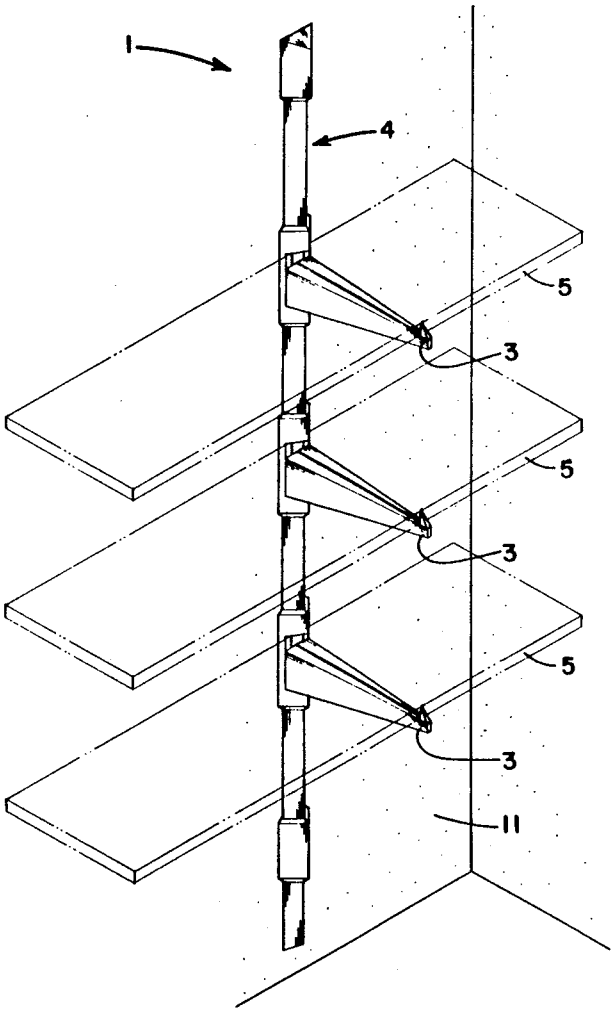
FIG. 1 is a an overall view of a preferred embodiment of the shelf bracket assembly in an assembled configuration.

Shown in FIG. 1 is a three-dimensional view of a preferred embodiment of the shelf bracket assembly 1 in an assembled configuration. FIG. 2 depicts an exploded view of the same assembly 1. The major components of assembly 1 are support strip 2, shelf brackets 3, and covering means 4. Support strip 2 is preferably, although not required to be, a 5/8" wide shelf support strip having slots 8 arranged in vertical alignment along the length of strip 2. It is to be understood that whatever the dimensions of support strip 2 may be, the various features of the present invention may be modified to adapt to those dimensions while still remaining within the scope of the claims presented herein. Strip 2 is fastened to wall 11 by screws (not shown) or by any other suitable manner known to those in the art.

Figure 3:
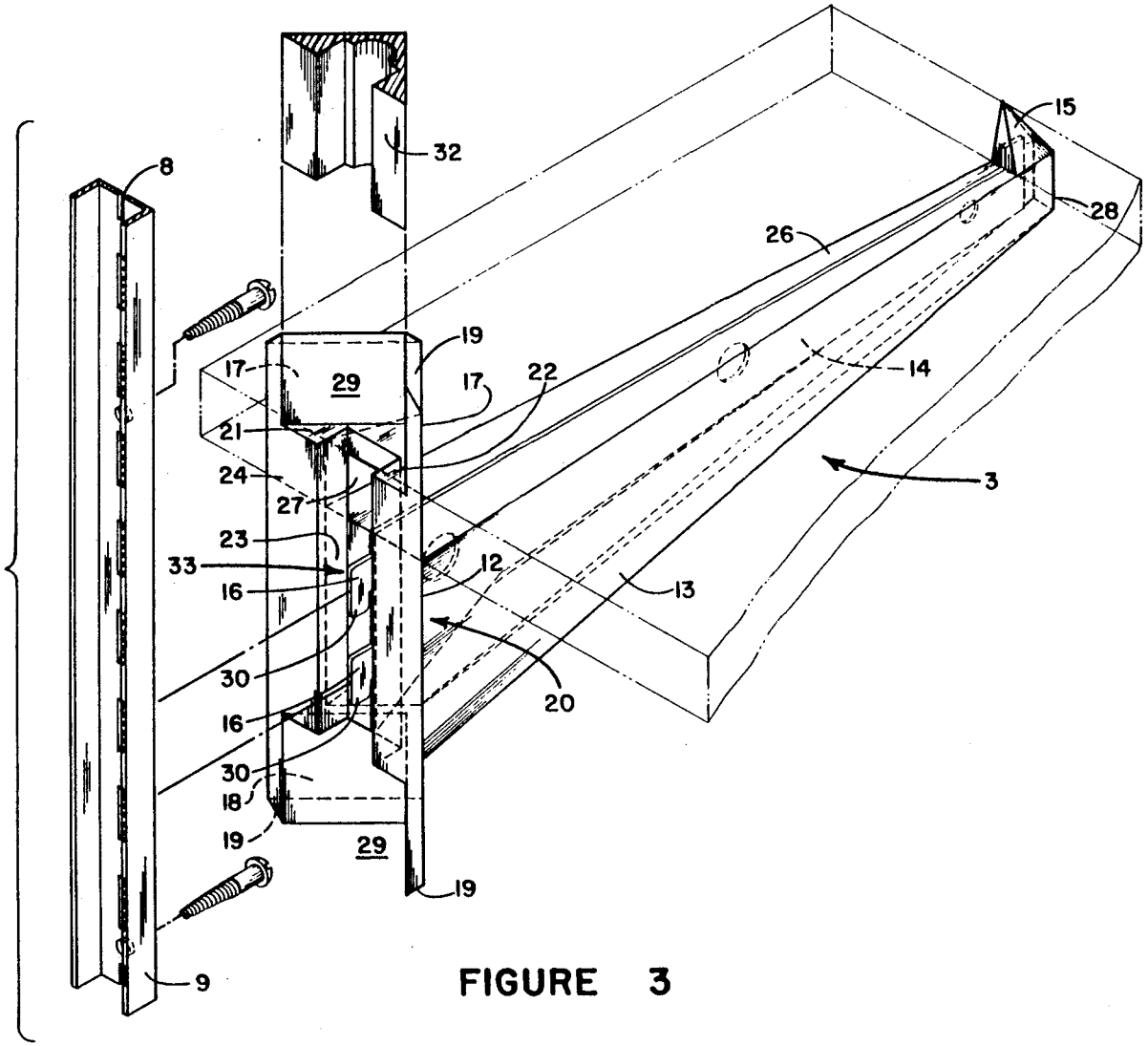
FIG. 3 is a view of a shelf bracket depicting the base, support member, hooked portions, and stabilizer flanges.

Shelf bracket 3, shown in FIGS. 1, 2, and 3, is primarily comprised of base 12 and horizontal support member 13. Support member 13 is molded as a part of base 12 and has a support surface 26 which is generally perpendicular to support strip 2 and designed to be in supportive contact with a shelf 5. Shelf stop 15 is 16 preferably attached at the distal end 28 of support member 13 in order to retain shelf 5 in position. Additionally, recess 27 is formed in base 12 above support surface 26 allowing shelf 5 to abut support strip 2 in order to maintain a minimum of stress on base 12. For structural reinforcement, support member 13 preferably contains internal metal plate 14 extending through its length. Hooked portions 16 are formed as a part of metal plate 14 and protrude from base 12 on a side opposite support member 13. Hooked portions 16 have downward-pointing tabs and are shaped to matingly fit into two consecutive slots 8 of support strip 2 in a manner which locks base 11 to support strip 2. Base 12 also includes stabilizing means 20 for contacting wall 11 and support strip 2. Stabilizing means 20 may simply comprise left and right stabilizer flanges 21, 22 which each include first surface 23 in contact with one of support strip exterior sides 9 and second surface 24 in contact with wall 11. Stabilizer flanges 21, 22, therefore, operate to form a channel 33 under which support strip 2 resides when shelf bracket 3 is attached. Upper end 17 of base 12 contains retainer flange 19, whose function will be described later, extending upward along the length of base 12 to form a cavity 29 above stabilizer flanges 21, 22. A symmetrical, yet identical, arrangement is present at lower end 18 of base 12, with retainer flange 19 extending in a downward direction.

Figure 4:
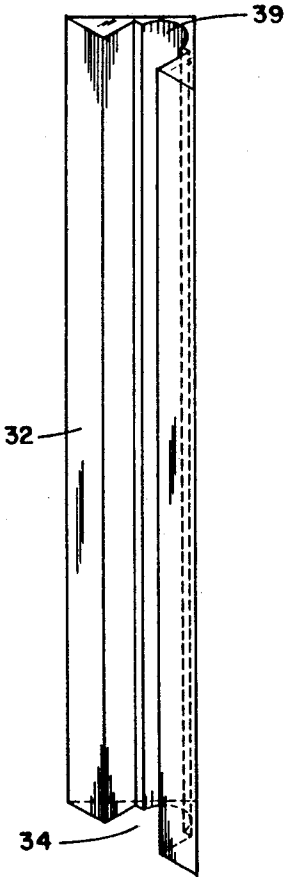
FIG. 4 is a view of the divider sections depicting the axial clearance groove and the channel.

Covering means 4, depicted in FIGS. 1, 2, and 4, is preferably a number of intermediate divider sections 31, a cap section 6, a top divider section 50, a bottom section 7, and a bottom divider section 49. Divider sections 31, 49, 50 are of sufficient length to cover support strip 2 between consecutive shelf brackets 3 and also between an uppermost shelf bracket 3 and cap section 6, and between a bottommost shelf bracket 3 and bottom section 7. Each divider section 31, 49, 50 is comprised of divider body 32 having channel 34 identical in width to channel 33 in shelf bracket 3 in order to completely cover a portion of support strip 2. Also present is an axial clearance groove 39 parallel to channel 34 to allow the heads of screws or other fastening hardware used to attach support strip 2 to wall 11 to protrude from support strip 2 without interfering with the proper fitting of divider sections 31, 49, 50. Each end of intermediate divider sections 31 is sized to fit within the cavity 29 of either upper end 17 or lower end 18 of base 12 and is retained by retainer flange 19 in either case. The lengths of intermediate divider sections 31 are determined entirely by the spacing between shelf brackets 3. The function of top divider section 49 and bottom divider section 50 are discussed below. It should be noted that no axial clearance groove 39 is required in base 12 of shelf brackets 3, because hooked portions 16 will always have to be placed in slots 8 which 10 do not allow obstruction to tabs 30 by existing hardware used to attach support strip 2 to wall 11.

Figure 5:
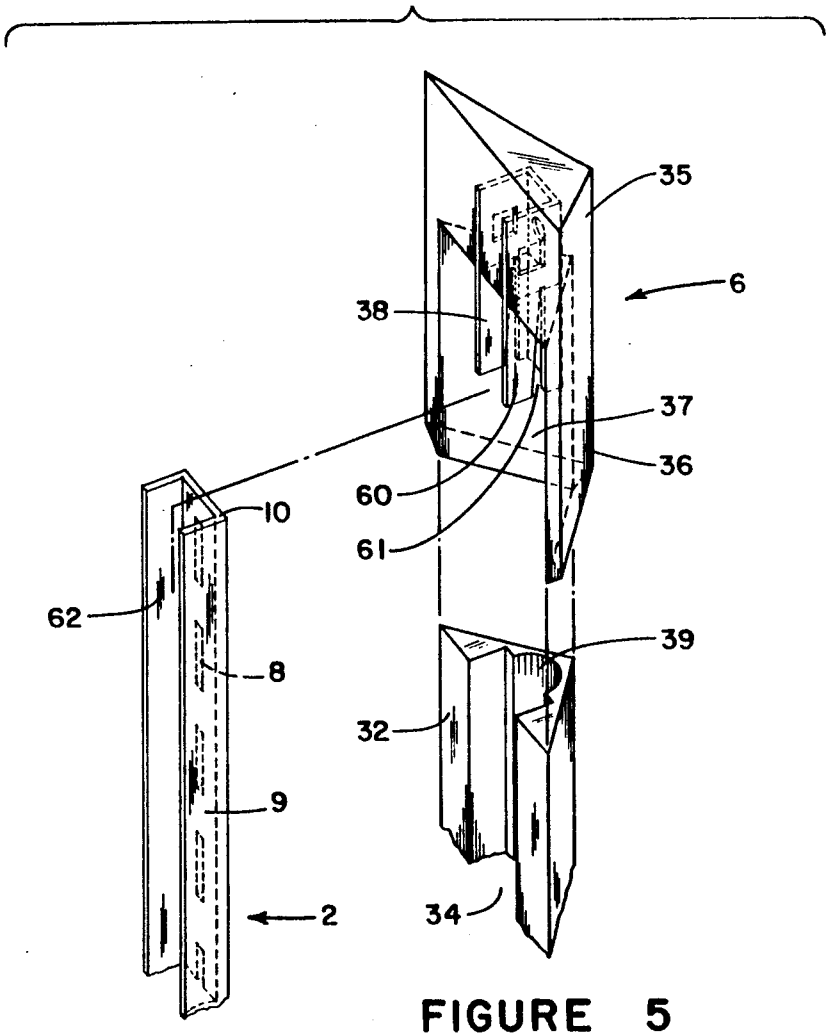
FIG. 5 is a view of the cap section showing the clip used for attaching the cap section to the support strip.

As shown in FIGS. 1, 2, and 5, cap section 6 includes body 35 having a downwardly extending retainer flange 36 and cap cavity 37 large enough to avoid the heads of any existing support strip screws (not shown) used to attach support strip 2 to wall 11. Metal clip 38 extending into cap cavity 37 is formed as an integral part of body 35 and matably engages upper edge 10 of support strip 2 for attachment. Metal clip 38 consists of two downwardly extending tabs 60, each of which incoporates a V-shaped slot 61 as shown in FIG. 5, said tabs 60 being arranged to straddle any existing strip support screws used to attach support strip 2 to wall 11, but yet fitting within the inside edges 62 of support strip sides 9. Cap cavity 37 and retainer flange also 36 act to receive the top end of top divider section 50 that is used to cover the portion of support strip 2 between the uppermost shelf bracket 3 and cap section 6.

Figure 6:
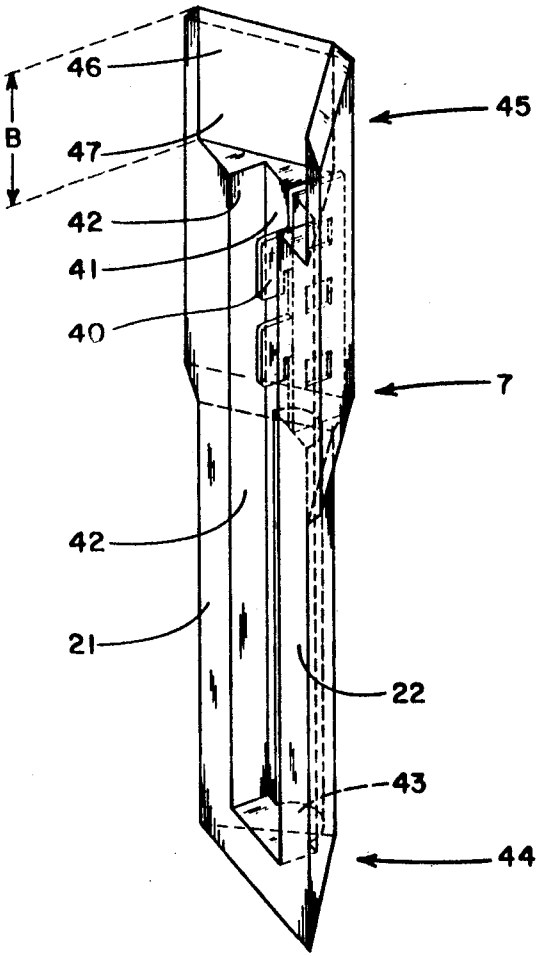
FIG. 6 is a view of the bottom section showing the hooked portions used to attach the bottom section to the support strip.

Bottom section 7, shown in FIGS. 1, 2, and 6, is attached to support strip 2 by metal hooked portions 40 (identical in structure and function to hooked portions 16 of shelf bracket 3) permanently attached to body 41. Hooked portions 40 engage two consecutive slots 8 of support strip 2 in a similar manner to shelf bracket 3. Channel 42 and stabilizer flanges 21, 22 are formed lengthwise along body 41 in order to completely cover a portion of support strip 2, with channel 42 being identical in width to channel 33 in shelf bracket 3. It is to be noted that stabilizer flanges 21, 22 in bottom section 7 are present only to maintain a consistent cross-section for aesthetic purposes, but that channel 42, as such, is required to completely cover support strip 2. Lower end 44 extends downward from body 41 and is identical in structure and function to divider sections 31, 49, 50 except that lower end 44 is an integral extension of body 41. As in divider sections 31, 49, 50, lower end 44 also contains an axial clearance groove 43 parallel to channel 42 in order to provide clearance for fastening hardware for support strip 2. Upper end 45 of body 41 includes a retainer flange 46 and accompanying cavity 47 for retaining the bottom end of bottom divider section 49 that is used to cover the portion of support strip 2 between the bottommost shelf bracket 3 and bottom section 7.

Figure 7:
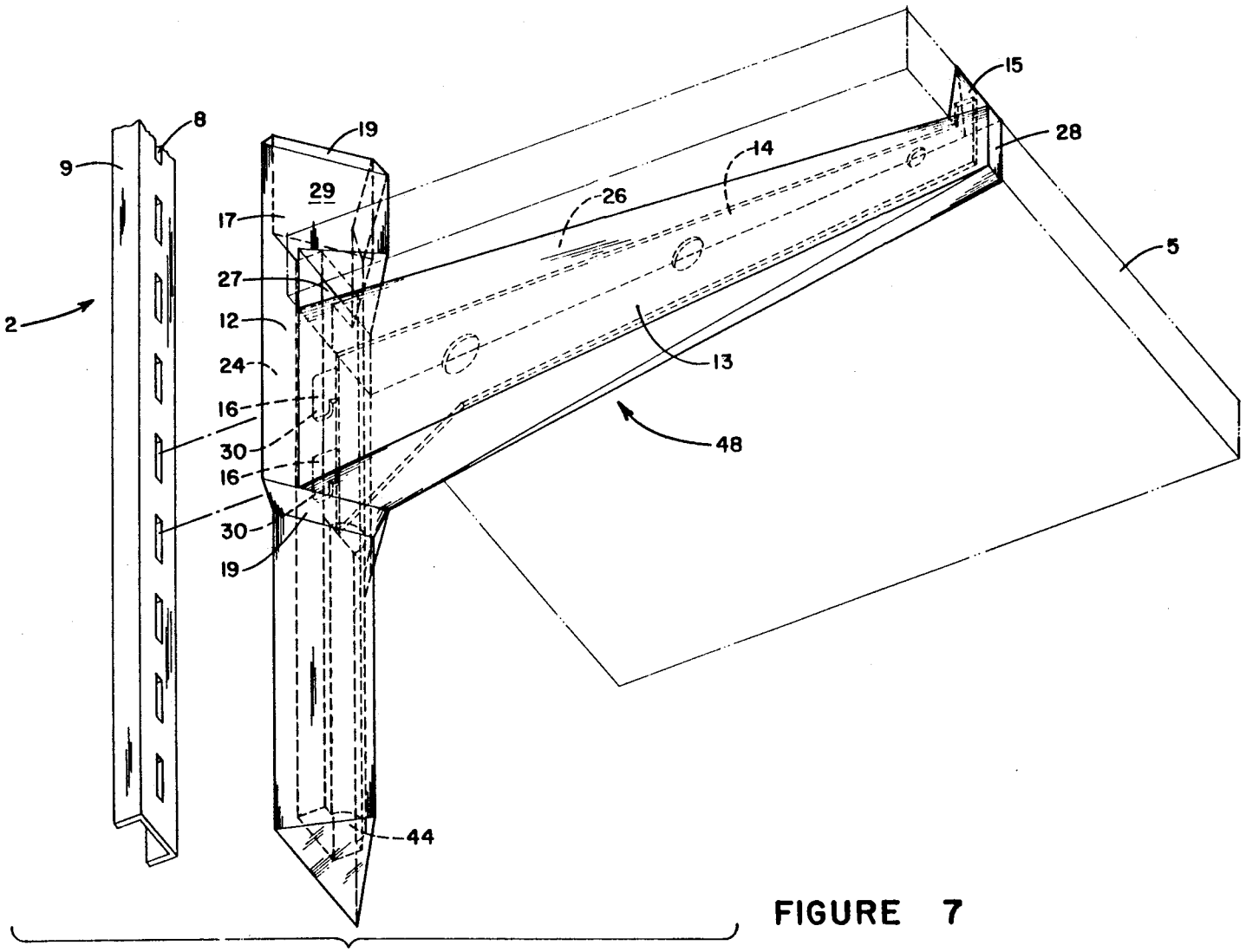
FIG. 7 is an underside view of the modified shelf bracket used as an alternative to the bottom section.

In an alternative embodiment shown in FIG. 7 as an underside view, a modified shelf bracket 48 may be used instead of bottom section 7. The modified shelf bracket 48 has all of the features of original shelf bracket 3, except that lower end 18 of shelf bracket 3 is replaced by lower end 44 of bottom section 7. Such a configuration still allows all of support strip to remain covered, but now affords the use of an additional shelf 5.

In operation, at least two support strips 2 are fastened to wall 11 by screws or other hardware appropriate for secure attachment. The user must decide how many shelves 5 he wishes to have as well as the desired spacing between shelf brackets 3, because the lengths of intermediate, bottom, and top divider sections 31, 49, 50 are determined by the spacing between shelf brackets 3 as well as by the distance between cap section 6 and the uppermost shelf bracket 3 and by the distance between bottom section 7 and the bottommost shelf bracket 3. Once these decisions are made, divider sections 31, 49, 50 are Cut to size, and assembly of the present invention 1 can begin. For example, if there are to be three (3) shelves 5, the complete assembly will comprise three (3) shelf brackets 3, a bottom section 7, a bottom divider section 49, a cap section 6, a top divider section 50, and two (2) intermediate divider sections 31.

Bottom section 7 is first attached to support strip 2 by way of hooked portions 40 in a manner that covers the lower end of support strip 2. Axial clearance groove 43 assures a proper fit between bottom section 7 and support strip 2 by preventing obstruction from screws or fastening hardware typically existing near the ends of support strip 2. Bottom divider section 49 is then mounted over support strip 2 with its lower end placed within cavity 47 until it meets stabilizer flanges 21, 22 so that retainer flange 46 partially covers the end of bottom divider section 49. A bottommost shelf bracket 3 is then attached to support strip 2 by its own hooked portions 16 such that the upper end of bottom divider section 49 is surrounded by cavity 29 of lower end 18 of base 12 and is retained to support strip 2 by retainer flange 19. Axial clearance groove 39 also assures a proper fit between bottom divider section 49 and support strip 2 by preventing obstruction from hardware typically used to attach support strip 2 to wall 11. It can be seen from the above description that the degree of precision in cutting bottom divider section 49 is correspondingly lessened as either or both retainer flange 19 of shelf bracket 3 and/or retainer flange 46 of bottom section 7 are lengthened. In doing this, however, it is important for bottom divider section 49 to be cut at a length which is greater than the distance between the end of retainer flange 19 and the end of retainer flange 46 (shown as distance A) plus the distance between the top of channel 42 and the end of retainer flange 46 (shown as distance B). Cutting bottom divider section 49 to a length less than just described would cause bottom divider section 49 to be in contact only with bottom section 7, rather than with both bottom section 7 and shelf bracket 3 as intended. As should be apparent to one skilled in the art, a similar relationship exists between intermediate and top divider sections 31, 50, cap section 6 and the remaining shelf brackets 3.

Once the bottommost shelf bracket 3 is in place, an intermediate divider section 31 is placed over support strip 2 with its lower end placed within cavity 29 of upper end 17 of base 12 of the bottommost shelf bracket 3 until it meets stabilizer flanges 21, 22 so that retainer flange 19 partially covers the end of intermediate divider section 31. Another shelf bracket 3 is then attached to support strip 2 in a predetermined place higher than bottommost shelf bracket 3 by its hooked portions 16 such that the upper end of intermediate divider section 31 is surrounded by cavity 29 of lower end 18 of base 12 of the higher shelf bracket 3 and is retained to support strip 2 by retainer flange 19 of that same shelf bracket 3. Axial clearance groove 39 again assures a proper fit between intermediate divider section 31 and support strip 2 by preventing obstruction from hardware typically used to attach support strip 2 to wall 11. The above procedure is followed for each shelf bracket 3 desired in the shelf bracket assembly 1 until the last and highest shelf bracket 3 is mounted.

When the last and highest shelf bracket 3 is placed onto support strip 2, top divider section 50 is mounted to support strip 2 with its lower end placed within cavity 29 until it meets stabilizer flanges 21, 22 of the highest shelf bracket 3 so that retainer flange 19 of that shelf bracket 3 partially covers the lower end of top divider section 50. Cap section is then attached to support strip 2 by way of metal clip 38 such that the upper end of top divider section 50 is enclosed within cavity 37 and retained by retainer flange 36 of cap section 6. When an identical arrangement is completed on at least one parallel support strip 2, the shelf bracket assembly 1 is ready for installation of shelves 5. Shelves 5 are simply placed onto horizontal support members 13 of shelf brackets 3 such that their rear edges fit within recesses 27 and their front edges fit within shelf stops 15. Upon completion of the installation of shelves 5, the shelf bracket assembly 1 is then ready for conventional use.

If the modified shelf bracket 48 is used in an alternate embodiment instead of bottom section 7, then modified shelf bracket 48 would simply be placed first on support strip 2. Once this is done, the remainder of the assembly procedure would be as described above.

Other embodiments of the apparatus and method of the invention will occur to those skilled in the art, and are intended to be included within the scope and spirit of the following claims.

I claim:

1. A shelf bracket assembly, comprising:

(a) a plurality of vertical shelf bracket support strips operatively attached to a wall, each said strip having a plurality of slots aligned vertically along the length of said support strips;

(b) a plurality of shelf brackets operatively attached to said support strips, each said bracket comprising:

(i) a base comprising an upper end, a lower end, and vertically aligned hooked portions between said upper and lower ends of a size and shape to lockingly fit within said vertical slots of said support strip; and (ii) a horizontal support member fixedly connected to said base and of a size and strength capable of supporting at least half the weight of a shelf; and (c) cover means operatively attached to said support strips for completely covering said support strips in the space between said shelf brackets, in the space above a top said shelf bracket and in the space below a bottom said shelf bracket.

2. An assembly according to claim 1, wherein said shelf bracket further includes a recess in said base above said support member of a size sufficient to allow abutting contact between said shelf and said support strip.

3. An assembly according to claim 1, wherein said covering means comprises:

(a) one or more intermediate divider sections operatively attached to and between each pair of consecutive said shelf brackets;

(b) a cap section operatively attached to the top of said support strip above an uppermost shelf bracket;

(c) a bottom section having a body operatively attached to the bottom of said support strip below a bottommost shelf bracket;

(d) a top divider section operatively attached to and between said cap section and said uppermost shelf bracket; and (e) a bottom divider section operatively attached to and between said bottom section and said bottommost shelf bracket.

4. An assembly according to claim 3, wherein said bottom section further comprises a horizontal support member fixedly connected to said body and of a size and strength capable of supporting at least half the weight of a shelf.

5. An assembly according to claim 3, wherein each of said divider sections, cap sections, and bottom sections further comprises an axial clearance groove for permitting clearance for fastening hardware of said support strip.

6. An assembly according to claim 3, wherein said cap section further comprises a metal clip means for matably engaging an upper edge of said support strip, and a retainer flange sized to retain an end of said top divider section.

7. An assembly according to claim 3, wherein said bottom section further comprises at least two said hooked portions for locking engagement with said vertical slots of said support strip, and an upper end having a retainer flange sized to retain an end of said bottom divider section.

8. An assembly according to claim 3, wherein said cap section further includes a retainer flange sized to retain an end to said top divider section, and a metal clip, comprising:

(a) a pair of downwardly extending tabs, each said tab having an inverted V-shaped slot for mating engagement with an upper edge of said support strip which is parallel with said wall, said tabs being spaced apart from one another a distance less than the inside width of said support strip, but greater than the width of fastening hardware for said support strip; and (b) wherein said inverted V-shaped slot in each said tab includes a vertical, wall-facing edge and an inclined, room-facing edge for allowing attachment of said cap section to said upper edge of said support strip regardless of the distance of said upper edge from said wall.

9. In combination with a wall and a plurality of shelf support strips, each of said strips having a vertically slotted rib section protruding a fixed distance from said wall, a shelf bracket assembly, comprising:

(a) a plurality of shelf brackets operatively attached to said support strips, each said bracket comprising:

(i) a base comprising an upper end, a lower end, and vertically aligned hooked portions between said upper and lower ends of a size and shape to lockingly fit within said vertical slots of said support strip;

(ii) a horizontal support member fixedly connected to said base and of a size and strength capable of supporting at least half the weight of a shelf; and (iii) stabilizing means fixedly connected to said base for simultaneously contacting said wall and said strip to provide stabilization of said shelf bracket in a horizontal plane; and (b) cover means operatively attached to said support strips for completely covering said support strips in the space between said shelf brackets, in the space above a top said shelf bracket and in the space below a bottom said shelf bracket.

10. An assembly according to claim 9, wherein said stabilizing means comprises a pair of stabilizer flanges, each said flange comprising:

(a) a first surface parallel to a side of said support strip operatively in contact with said support strip; and (b) a second surface parallel to said wall operatively in contact with said wall.

11. An assembly according to claim 9, wherein said shelf bracket further includes a recess in said base above said horizontal support member of a size sufficient to allow abutting contact between said shelf and said support strip.

12. An assembly according to claim 9, wherein said cover means comprises:

(a) one or more intermediate divider sections operatively attached to and between each pair of consecutive said shelf brackets;

(b) a cap section operatively attached to the top of said support strip above an uppermost shelf bracket;

(c) a bottom section having a body operatively attached to the bottom of said support strip below a bottommost shelf bracket;

(d) a top divider section operatively attached to and between said cap section and said uppermost shelf bracket; and (e) a bottom divider section operatively attached to and between said bottom section and said bottommost shelf bracket.

13. An assembly according to claim 12, wherein said bottom section further comprises a horizontal support member fixedly connected to said body and of a size and strength capable of supporting at least half the weight of a shelf.

14. An assembly according to claim 12, wherein each of said divider sections, cap sections, and bottom sections further comprises an axial clearance groove for permitting clearance for fastening hardware of said support strip.

15. An assembly according to claim 12, wherein said cap section further comprises a metal clip means for matably engaging an upper edge of said support strip, and a retainer flange sized to retain an end of said top divider section.

16. An assembly according to claim 12, wherein said bottom section further comprises at least two said hooked portions for locking engagement with said vertical slots of said support strip, and an upper end having a retainer flange sized to retain an end of said bottom divider section.

17. An assembly according to claim 12, wherein said cap section further includes a retainer flange sized to retain an end of said top divider section, and a metal clip, comprising:

(a) a pair of downwardly extending tabs, each said tab having an inverted V-shaped slot for mating engagement with an upper edge of said support strip which is parallel with said wall, said tabs being spaced apart from one another a distance less than the inside width of said support strip, but greater than the width of fastening hardware for said support strip; and (b) wherein said inverted V-shaped slot in each said tab includes a vertical, wall-facing edge and an inclined, room-facing edge for allowing attachment of said cap section to said upper edge of said support strip regardless of the distance of said edge from said wall.

* * * * *